US007089979B2

(12) United States Patent
Cooper et al.

(10) Patent No.: US 7,089,979 B2
(45) Date of Patent: Aug. 15, 2006

(54) ERGONOMIC ROUTER

(75) Inventors: Randy G. Cooper, Jackson, TN (US); Mark A. Etter, Humboldt, TN (US); Greg K. Griffin, Humboldt, TN (US); Ginger L. Allen, Jackson, TN (US); Derrick Kilbourne, Deerfield Beach, FL (US)

(73) Assignee: Black & Decker Inc., Newark, DE (US)

( * ) Notice: Subject to any disclaimer, the term of this patent is extended or adjusted under 35 U.S.C. 154(b) by 167 days.

(21) Appl. No.: 10/836,823

(22) Filed: Apr. 30, 2004

(65) Prior Publication Data

US 2006/0108024 A1 May 25, 2006

Related U.S. Application Data

(60) Provisional application No. 60/467,169, filed on May 1, 2003.

(51) Int. Cl.
*B27C 5/10* (2006.01)

(52) U.S. Cl. ..... 144/136.95; 144/154.5; 144/144.1; 409/182

(58) Field of Classification Search ..... 144/136.95, 144/144.1, 154.5, 371; 409/182, 181
See application file for complete search history.

(56) References Cited

U.S. PATENT DOCUMENTS

| | | | | |
|---|---|---|---|---|
| 712,843 | A | 11/1902 | Paul | |
| 1,370,895 | A | 3/1921 | Loomis | |
| 1,514,894 | A | 11/1924 | Carter | |
| 1,565,790 | A | 12/1925 | Carter | |
| 1,584,078 | A | 5/1926 | Carter | |
| 1,820,162 | A | 8/1931 | Salvat | |
| 1,874,232 | A | 8/1932 | Groene et al. | |
| 1,899,883 | A * | 2/1933 | Sacrey | 144/136.1 |
| 2,353,202 | A | 7/1944 | Tautz | 144/134 |
| 2,395,158 | A * | 2/1946 | Ball | 30/477 |
| 2,425,245 | A | 8/1947 | Johnson | 121/36 |
| 2,504,880 | A | 4/1950 | Rittenhouse | 143/43 |
| 2,513,894 | A | 7/1950 | Rogers | 206/17 |
| 2,799,305 | A | 7/1957 | Groehn | 144/253 |

(Continued)

FOREIGN PATENT DOCUMENTS

| | | |
|---|---|---|
| CA | 500134 | 2/1954 |

(Continued)

OTHER PUBLICATIONS http://www.dremel.com/productdisplay/tool_template2.asp?SKU=9000-04&Color=99CCFF,#9000-04 Advantage Rotary Saw Kit, Mar. 21, 2003, 1 page.

(Continued)

*Primary Examiner*—Bena Miller
(74) *Attorney, Agent, or Firm*—Scott B. Markow

(57) ABSTRACT

The present invention is directed to a router including a motor housing for at least partially enclosing a motor, a base having a sleeve for receiving the motor housing therein. The base is constructed to at least partially support the motor housing on a workpiece. The router additionally includes an electrical switch disposed substantially in a quadrant, defined by a first axis extending through generally opposing handles, and a second axis, extending normal to the first axis, and generally bisecting the motor housing, of the motor housing. Preferably, the electrical switch is disposed in the range of 30° (thirty degrees) to 60° (sixty degrees) from the second axis and particularly at approximately 45° (forty-five degrees) to allow for comfortable grasping of the motor housing/base, easy repeatable switch manipulation, and the like.

15 Claims, 4 Drawing Sheets

U.S. PATENT DOCUMENTS

| | | | | | |
|---|---|---|---|---|---|
| 3,289,718 | A | | 12/1966 | Willis | 144/136 |
| 3,436,090 | A | | 4/1969 | Lange et al. | 280/11.37 |
| 3,443,479 | A | * | 5/1969 | Eikermann et al. | 409/182 |
| 3,447,001 | A | * | 5/1969 | Zelik | 310/50 |
| 3,451,133 | A | | 6/1969 | Hathaway et al. | 32/22 |
| 3,466,973 | A | | 9/1969 | Rees | 90/12 |
| 3,481,453 | A | | 12/1969 | Shreve, III et al. | 206/45.14 |
| 3,487,747 | A | | 1/1970 | Burrows et al. | 90/11 |
| 3,494,395 | A | | 2/1970 | Graham | 144/136 |
| 3,512,740 | A | | 5/1970 | Podwalny | 248/154 |
| 3,587,387 | A | * | 6/1971 | Burrow | 409/182 |
| 3,710,833 | A | | 1/1973 | Hammer e tal. | 144/134 A |
| 3,767,948 | A | * | 10/1973 | Batson | 310/50 |
| 3,791,260 | A | | 2/1974 | Ambler et al. | 90/12 D |
| 3,827,820 | A | | 8/1974 | Hoffman | 403/165 |
| 3,905,273 | A | | 9/1975 | Shook | 90/11 R |
| 4,051,880 | A | | 10/1977 | Hestily | 144/252 R |
| 4,085,552 | A | | 4/1978 | Horine et al. | 51/166 R |
| 4,102,370 | A | | 7/1978 | Vess | 144/134 D |
| 4,108,225 | A | * | 8/1978 | Hestily | 144/154.5 |
| 4,143,691 | A | * | 3/1979 | Robinson | 144/154.5 |
| 4,239,428 | A | | 12/1980 | Berzina | 409/182 |
| 4,244,406 | A | * | 1/1981 | Stielper | 144/136.95 |
| 4,294,297 | A | | 10/1981 | Kieffer | 144/134 D |
| 4,319,860 | A | | 3/1982 | Beares | 409/182 |
| D267,492 | S | | 1/1983 | Schieber | D5/141 |
| 4,410,022 | A | | 10/1983 | Peterson | 144/1 F |
| 4,445,811 | A | | 5/1984 | Sanders | 409/182 |
| 4,537,234 | A | | 8/1985 | Onsrud | 144/134 A |
| 4,562,872 | A | | 1/1986 | Fushiya et al. | 144/134 |
| 4,593,466 | A | | 6/1986 | O'Brien | 30/272 A |
| D286,132 | S | | 10/1986 | Yamamoto | D8/67 |
| 4,615,654 | A | | 10/1986 | Shaw | 409/178 |
| 4,652,191 | A | | 3/1987 | Bernier | 409/182 |
| 4,679,606 | A | | 7/1987 | Bassett | 144/134 A |
| 4,718,468 | A | | 1/1988 | Cowman | 144/134 D |
| 4,738,571 | A | | 4/1988 | Olson et al. | 409/137 |
| 4,770,573 | A | | 9/1988 | Monobe | 409/182 |
| D300,501 | S | | 4/1989 | Zurwelle | D8/67 |
| 4,830,074 | A | | 5/1989 | Lundblom | 144/251 B |
| RE33,045 | E | | 9/1989 | Gronholz et al. | 144/134 |
| 4,872,550 | A | | 10/1989 | Stranges | 206/315.1 |
| 4,924,571 | A | | 5/1990 | Albertson | 30/121 |
| 4,938,642 | A | | 7/1990 | Imahashi et al. | 409/182 |
| 5,012,582 | A | | 5/1991 | Bristol et al. | 30/391 |
| 5,025,841 | A | | 6/1991 | Totten | 144/134 R |
| 5,056,375 | A | | 10/1991 | Kapton et al. | 74/89.15 |
| 5,062,460 | A | | 11/1991 | DeLine | 144/136 |
| 5,074,724 | A | | 12/1991 | McCracken | 409/182 |
| 5,078,557 | A | | 1/1992 | McCracken | 409/182 |
| D323,935 | S | | 2/1992 | Ward | D3/73 |
| 5,088,865 | A | | 2/1992 | Beth et al. | 409/182 |
| 5,094,575 | A | | 3/1992 | Kieser et al. | 409/182 |
| D326,597 | S | | 6/1992 | Lee | D8/68 |
| 5,117,879 | A | | 6/1992 | Payne | 144/1 F |
| 5,139,061 | A | | 8/1992 | Neilson | 144/134 A |
| 5,181,813 | A | | 1/1993 | McCracken | 409/182 |
| 5,188,492 | A | | 2/1993 | McCracken | 409/182 |
| 5,191,621 | A | | 3/1993 | Brok | 382/1 |
| 5,207,253 | A | * | 5/1993 | Hoshino et al. | 144/136.95 |
| D337,501 | S | | 7/1993 | Witt | D8/70 |
| D340,174 | S | | 10/1993 | Hoshino et al. | D8/67 |
| D341,305 | S | | 11/1993 | Svetlik | D8/70 |
| 5,265,657 | A | | 11/1993 | Matsumoto et al. | 144/134 D |
| 5,273,089 | A | | 12/1993 | Fuchs et al. | 144/134 D |
| 5,289,861 | A | | 3/1994 | Hedrick | 144/134 A |
| 5,308,201 | A | | 5/1994 | Wilson et al. | 409/134 |
| D349,637 | S | | 8/1994 | Hoshino et al. | D8/67 |
| 5,347,684 | A | | 9/1994 | Jackson | 16/111 R |
| 5,353,474 | A | | 10/1994 | Good et al. | 16/111 R |
| 5,353,852 | A | | 10/1994 | Stolzer et al. | 144/134 D |
| 5,361,851 | A | | 11/1994 | Fox | 173/170 |
| 5,368,424 | A | | 11/1994 | Bettenhausen | 409/182 |
| 5,429,235 | A | | 7/1995 | Chen | 206/373 |
| 5,445,479 | A | | 8/1995 | Hillinger | 408/16 |
| 5,452,751 | A | | 9/1995 | Engler, III et al. | 144/1 F |
| 5,469,601 | A | | 11/1995 | Jackson | 16/111 R |
| 5,511,445 | A | | 4/1996 | Hildebrandt | 745/558.5 |
| 5,584,620 | A | | 12/1996 | Blickhan et al. | 409/137 |
| 5,590,989 | A | | 1/1997 | Mulvihill | 409/182 |
| 5,598,892 | A | | 2/1997 | Fox | 173/170 |
| 5,613,813 | A | | 3/1997 | Winchester et al. | 409/182 |
| 5,640,741 | A | | 6/1997 | Yano | 16/114 R |
| 5,652,191 | A | | 7/1997 | Patterson | 502/162 |
| 5,662,440 | A | | 9/1997 | Kikuchi et al. | 409/182 |
| 5,671,789 | A | | 9/1997 | Stolzer et al. | 144/154.5 |
| 5,678,965 | A | | 10/1997 | Strick | 409/132 |
| 5,699,844 | A | | 12/1997 | Witt | 144/329 |
| 5,725,036 | A | | 3/1998 | Walter | 144/135.2 |
| 5,725,038 | A | | 3/1998 | Tucker et al. | 144/371 |
| 5,772,368 | A | | 6/1998 | Posh | 409/182 |
| 5,803,684 | A | | 9/1998 | Wang | 409/229 |
| 5,813,805 | A | | 9/1998 | Kopras | 408/241 R |
| 5,829,931 | A | | 11/1998 | Doumani | 409/132 |
| 5,853,273 | A | | 12/1998 | Coffey | 409/182 |
| 5,853,274 | A | | 12/1998 | Coffey et al. | 409/182 |
| 5,902,080 | A | | 5/1999 | Kopras | 409/182 |
| 5,909,987 | A | | 6/1999 | Coffey et al. | 409/131 |
| 5,913,645 | A | | 6/1999 | Coffey | 409/182 |
| 5,918,652 | A | | 7/1999 | Tucker | 144/371 |
| 5,921,730 | A | * | 7/1999 | Young et al. | 409/182 |
| D416,460 | S | | 11/1999 | Bosten et al. | D8/67 |
| 5,988,241 | A | | 11/1999 | Bosten et al. | 144/154.5 |
| 5,998,897 | A | | 12/1999 | Bosten et al. | 310/89 |
| 6,050,759 | A | | 4/2000 | Bone | 409/182 |
| 6,065,912 | A | | 5/2000 | Bosten et al. | 409/134 |
| 6,079,915 | A | | 6/2000 | Bosten et al. | 409/182 |
| 6,079,918 | A | | 6/2000 | Buddendeck et al. | 409/182 |
| 6,182,723 | B1 | | 2/2001 | Bosten et al. | 144/154.5 |
| 6,183,400 | B1 | | 2/2001 | Pope | 482/92 |
| D444,364 | S | | 7/2001 | Evans | D8/67 |
| 6,261,036 | B1 | | 7/2001 | Bosten et al. | 409/182 |
| 6,266,850 | B1 | | 7/2001 | Williams et al. | 16/430 |
| 6,289,952 | B1 | | 9/2001 | Jones et al. | 144/135.2 |
| 6,305,447 | B1 | | 10/2001 | Rousseau | 144/135.2 |
| 6,318,936 | B1 | | 11/2001 | McFarlin, Jr. et al. | 409/131 |
| 6,419,429 | B1 | | 9/2002 | Kopras et al. | 409/182 |
| 6,443,675 | B1 | | 9/2002 | Kopras et al. | 409/182 |
| 6,443,676 | B1 | | 9/2002 | Kopras | 409/182 |
| 6,474,378 | B1 | | 11/2002 | Ryan et al. | 144/154.5 |
| 6,505,659 | B1 | | 1/2003 | Hummel | 144/135.2 |
| 6,520,224 | B1 | | 2/2003 | Smith | 144/135.2 |
| 6,520,227 | B1 | | 2/2003 | Mc Farlin, Jr. et al. | 144/371 |
| D473,439 | S | | 4/2003 | Grant et al. | D8/61 |
| 6,550,154 | B1 | | 4/2003 | Smith | 33/638 |
| 6,725,892 | B1 | | 4/2004 | McDonald et al. | 144/136.95 |
| 6,726,414 | B1 | | 4/2004 | Pientka et al. | 409/182 |
| 6,739,066 | B1 | | 5/2004 | Smith | 33/638 |
| 6,779,954 | B1 | | 8/2004 | Tomayko | 409/182 |
| 6,792,984 | B1 | | 9/2004 | Fontaine | 144/135.2 |
| 2002/0020466 | A1 | | 2/2002 | McFarlin, Jr. et al. | 144/135.2 |
| 2002/0043294 | A1 | | 4/2002 | McDonald et al. | 144/154.5 |
| 2002/0079021 | A1 | | 6/2002 | Smith | 144/135.2 |
| 2003/0188441 | A1 | * | 10/2003 | Patton | 30/381 |
| 2003/0205292 | A1 | | 11/2003 | Smith | 144/252.1 |
| 2003/0223835 | A1 | | 12/2003 | Hummel | 409/182 |
| 2004/0035495 | A1 | | 2/2004 | Hessenberger et al. | 144/136.95 |
| 2004/0194854 | A1 | | 10/2004 | McDonald et al. | 144/136.95 |

| | | | | |
|---|---|---|---|---|
| 2004/0200543 | A1 | 10/2004 | McDonald et al. | 144/136.95 |
| 2004/0250891 | A1 | 12/2004 | McDonald et al. | 144/136.95 |
| 2004/0253068 | A1 | 12/2004 | Gerhardt et al. | 409/182 |

FOREIGN PATENT DOCUMENTS

| | | |
|---|---|---|
| CA | 657748 | 2/1963 |
| CA | 2314653 | 7/2000 |
| GB | 712071 | 4/1952 |
| GB | 1037969 | 9/1965 |
| JP | 54051247 | 4/1979 |
| JP | 04297645 | 10/1992 |
| JP | 04297646 | 10/1992 |
| JP | 06136286 | 5/1994 |
| JP | 06164544 | 6/1994 |

OTHER PUBLICATIONS

Bosch 1617 Shop Router, Parts Diagram, Jul. 1998.

Bosch Router Models, Owners Manual, p. 1-22, http//www.boschtools.com.

Triton TRC-001 Review, 3.25 Plunge Router, http://www.mv.com/users/beposito/woodworking/triton/ , Feb. 27, 2004.

Triton 1/2" Precision Router (TRA 001), http://www.triton.net.au/products/router_2.html, p. 1-3, Feb. 27, 2004.

Triton TRC-001, Router Woodworking, http://www.patwarner.com/triton.html, p. 1-2, Feb. 27, 2004.

Triton 3 1/4hp Plunge Router Review, http://benchmark.20m.com/reviews/TritonRouter/TritonRouterReveiw.html,, p. 1-4, Feb. 27, 2004.

* cited by examiner

ERGONOMIC ROUTER

CROSS REFERENCE

The present application claims priority under 35 U.S.C. §119(e) to U.S. Provisional Patent Ser. No. 60/467,169, entitled: Router, filed on May 1, 2003, which is hereby incorporated by reference in its entirety.

The instant application hereby incorporates U.S. patent application Ser. No. 10/384,510, entitled Router Base Securing Mechanism, filed on Mar. 3, 2003 and U.S. patent application Ser. No. 10/458,167, entitled: Switch Assembly, filed on Jun. 10, 2003, U.S. patent application Ser. No. 10/686,300, entitled Quick Release Sub-Base Router, filed on Oct. 15, 2003, U.S. patent application Ser. No. 10/740,235, entitled Ergonomic Router Assembly, filed on Dec. 18, 2003 all of which are hereby incorporated by reference in their entirety.

FIELD OF THE INVENTION

The present invention relates to the field of hand tools and particularly to an ergonomically configured router.

BACKGROUND OF THE INVENTION

Routers are routinely utilized in a wide variety of woodworking projects. During normal operation (when not implemented with a router table), routers are typically manipulated via a pair of opposing handles, or via a D-shaped handle. In the previous manner, a user is capable of controlling the router in a secure manner. One difficulty experienced when utilizing a router is operating the router's electrical system. For example, on completing a task, a user typically turn off the power and let the bit run down or stop turning to prevent the bit from inadvertently contacting the workpiece. If a fixed base router or standard router is utilized, the electrical system may be inopportunely located. For example, if the motor housing rotates as the motor housing is positioned with respect to the base, the switch may be difficult to reach when grasping the manipulation handles. For example, a user may have to take one hand off a handle to operate the switch while holding a knob handle in the other hand. Further, the orientation of the switch may vary if the motor housing screws down (i.e., the motor housing threads into the base). Thus, a standardized motion may not be obtained.

Further, some router users wish to have close control over the router. For example, some users grasp the base/motor housing to manipulate the device. This method of use is typically employed by skilled woodworkers to allow them to hold his/her arms closer to his/her body than typically experienced when utilizing a D-shaped handle or a knob handle. Router components mounted to the base/motor housing may interfere with a user's grasp when holding the router in the previous manner. For example, a mechanical height adjustment device may be mounted to a sleeve included on the base for adjusting the motor housing/depth of cut. This arrangement may require a wider grasp, or cause the user to cant his/her hand and arm at an uncomfortable angle. This action may cause the user to tilt the router (out of normal) which may impact the overall finish of the workpiece.

Therefore, it would be desirable to provide an ergonomically configured router which includes components arranged so as to promote comfort and ease of use.

SUMMARY OF THE INVENTION

Accordingly, the present invention is directed to an ergonomic router wherein an electrical switch for controlling operation of the router is disposed substantially in a quadrant of the motor housing for promoting grasping of the motor housing while allowing efficient, repeatable, manipulation of the switch. In a further aspect of the invention, a height adjustment device for altering the position of the motor housing and thus, a bit or working tool is advantageously disposed to allow for ergonomic grasping without interfering with use of generally opposing handles included on the router or increasing the overall dimension between opposing handles which may be included on the router.

In a first aspect of the invention, a router includes a motor housing for at least partially enclosing a motor, a base having a sleeve for receiving the motor housing therein. The base is constructed to at least partially support the motor housing on a workpiece. The router additionally includes an electrical switch disposed substantially in a quadrant, defined by a first axis extending through generally opposing handles, and a second axis, extending normal to the first axis, and generally bisecting the motor housing, of the motor housing. Preferably, the electrical switch is disposed in the range of 30° (thirty degrees) to 60° (sixty degrees) from the second axis and particularly at approximately 45° (forty-five degrees) to allow for comfortable grasping of the motor housing/base, easy repeatable switch manipulation, and the like.

In further aspect of the invention, a height adjustment device is disposed in a quadrant, defined by a first axis extending through generally opposing handles, and a second axis, extending normal to the first axis, and generally bisecting the motor housing, of the motor housing. Preferably, the height adjustment device is mounted in a quadrant directly adjacent a quadrant including an electrical switch. In the previous manner, the router is configured to allow comfortable grasping of the motor housing (i.e., a user is capable of aligning himself/herself with the front of the router and generally grasp a side of the motor housing). It is further preferable that the height adjustment device be positioned in the range of 30° (thirty degrees) to 60° (sixty degrees) from the second axis so as to not increase the overall dimension of the motor housing/base between the generally opposing handles.

It is to be understood that both the forgoing general description and the following detailed description are exemplary and explanatory only and are not restrictive of the invention as claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Reference will now be made in detail to the presently preferred embodiments of the invention, examples of which are illustrated in the accompanying drawings. Those of skill in the art will appreciate that the principles of the present invention may be implemented on a variety of devices such as on a plunge router (dedicated or a removable motor housing plunge router), laminate trimmers, cutout tools, and the like without departing from the scope and spirit of the present invention.

Figure 1:
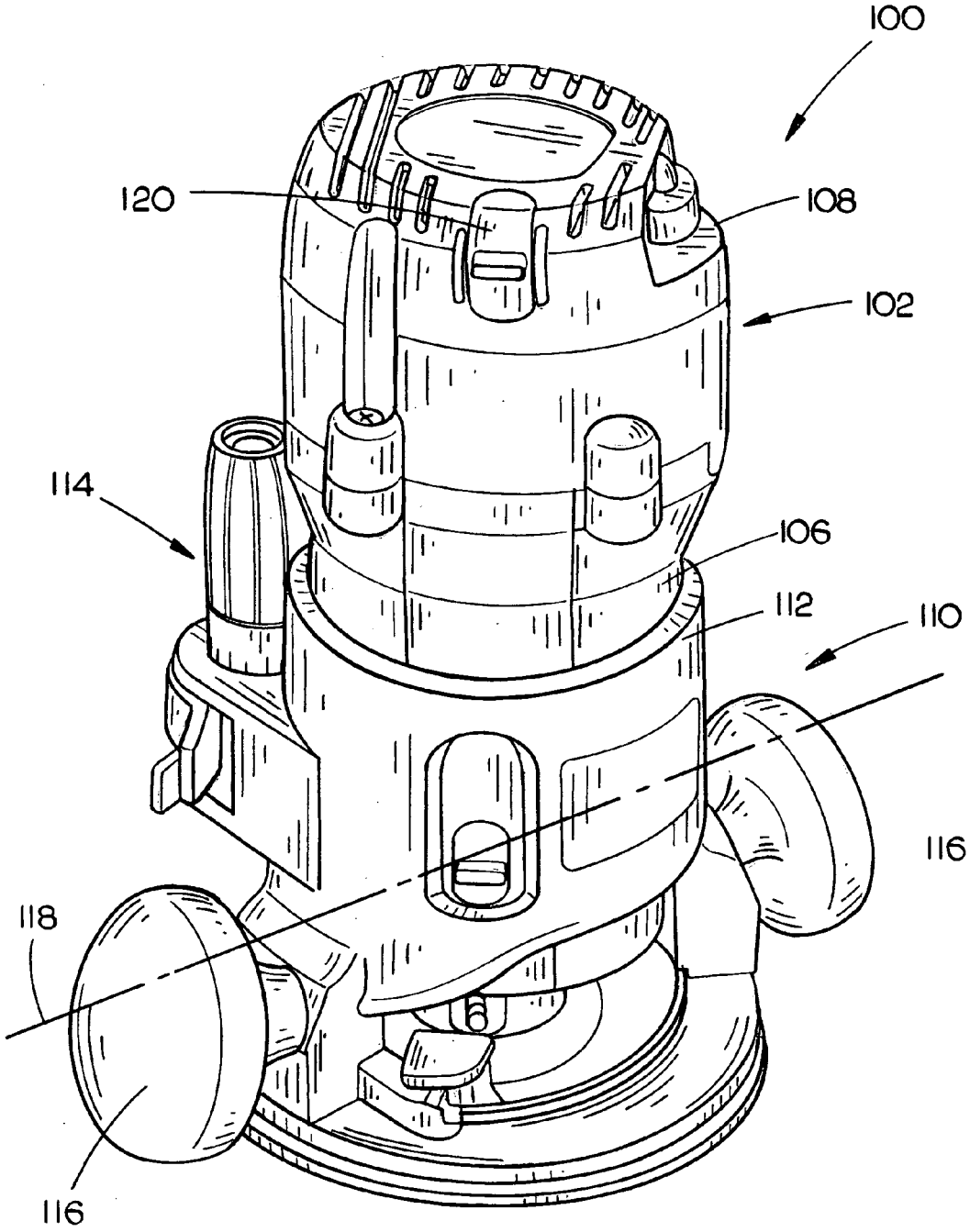
FIG. 1 is an isometric view of a router, including an electrical switch with dual actuators disposed in a quadrant of a motor housing.

Referring to FIG. 1, a router 100 in accordance with an embodiment of the present invention is discussed. In the present embodiment, the router 100 is a standard or fixed base router. A motor housing 102 is included in the router 100. The motor housing 102 generally encompasses a motor for rotating a drive shaft including a collet or device for securing a bit thereto. In the present embodiment, the motor housing 102 includes a first housing portion 106 and a second housing portion 108. In a further embodiment, a motor housing is unitary. Preferably, the first housing portion 106 is formed of a durable metal (sufficient to protect from normal use such as frictional wear, nicks) to form the primary housing structure while the second housing portion 108 may be formed of plastic such as a rigid plastic to allow for molding air vents, molded to accept various router components, and the like.

For example, the motor housing is generally cylindrical to be received in a corresponding aperture formed in a base 110. The receiving portion of the base or base sleeve 112 is configured in order to adjustably receive the motor housing 102 to allow for height adjustment. For example, the motor housing/drive shaft and thus the bit may be variously positioned with respect to the base 110 to allow for the depth at which the bit will remove material to be adjusted. A series of pin/grooves or mechanical connections (such as a configuration which prohibits rotation of the motor housing with respect to the base) may be included on the motor housing and correspondingly included as part of the base such as a groove included on the interior surface of the base sleeve 112. In the foregoing manner, the orientation of the motor housing may be fixed. Therefore, a user may instinctively reach for a selected area or zone with his/her thumb to operate the electrical system rather than having to check for the position of an electrical switch as may have occurred when utilizing a rotating or twist type router (a router in which the orientation of the motor housing varies as bit depth is changed). In the previous example, a user may instinctively operate the electrical system rather than having to check the housing's orientation. In additional examples, the motor housing orientation may be fixed by a height adjustment device. For example, a worm drive 114 included on the base 110 may intermesh with a rack secured on the motor housing 102 such that the motor housing travels in a vertical direction (in/out) of the base sleeve 112. Other suitable height adjustment devices include threaded rod systems, worm drive/engaging lug systems, step engagement systems, rack and pinion system, and the like for varying the height of the motor housing.

Preferably, the base 110 is configured to receive a pair of opposing handles such as knob type handles. For instance, a pair of apertures may be included in the sleeve 112 to connect the handles via a nut and bolt. For example, a knob type handle 116 (two are indicated) may be formed with threaded rod, which passes through the aperture included in the base, and is secured by the nut. Those of skill in the art will appreciate various types of handles may be utilized such as D-shaped handles, T-shaped handles, L-shaped handles, and the like. Additionally, the handle/handles may be connected via a variety of mechanisms, or formed unitary with the base or motor housing, as contemplated by one of ordinary skill in the art.

A first axis 118 is defined by the handles and/or the apertures for receiving the handles (in the case of two opposing handles). In further embodiments, a first axis may be defined by a single handle such as an axis extending through a D-shaped handle. In the previous example, the axis extends generally perpendicular to the motor housing so as to divide the router generally along the router's primary axis. In still further examples, if a hand grip (such as an elastomeric sleeve) is included on a motor housing/base, the first axis extends through the center of the grip. The first axis 118 may act to establish a front side (including an electrical switch 120) and a rear side or a side absent an electrical switch.

Figure 2A:
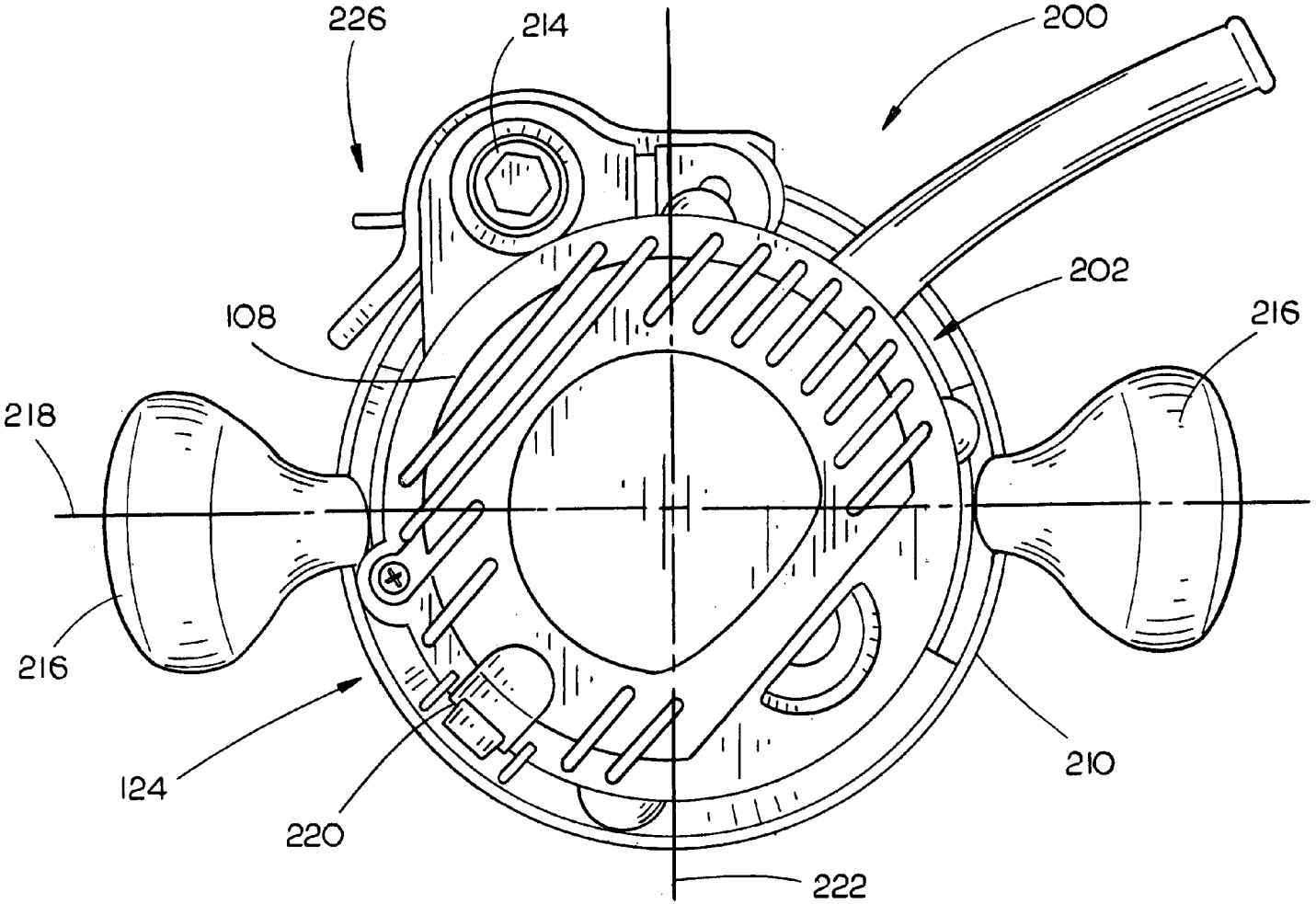
FIG. 2A is a top plan view of a router in accordance with an aspect of the present invention wherein a worm drive and electrical switch are disposed individually in quadrants of the router.

Referring now to FIG. 2A, an electrical switch 220 is included on the motor housing 102. In the current embodiment the electrical switch 220 is mounted generally adjacent to an end of the second housing portion 208. It is to be understood that the term switch is to encompass and include an actuator or physical devices (such as a lever) for manipulating the electrical components for causing electricity to flow or not to flow as desired. In further embodiments, an electrical switch may be mounted to the end of the motor housing, at an intermediate location on the first motor housing portion, may include multiple actuators, or the like for controlling the router's electrical system. For example, a first actuator may be disposed adjacent an end of the second motor housing and a second actuator disposed adjacent the drive shaft end of the first motor housing. (See generally FIG. 1) In the previous example, a single electrical switching mechanism may be utilized while the actuators are connected via a mechanical link to the switch. Alternatively, more than one electrical switch may be utilized (with an appropriate electrical configuration).

Figure 3:
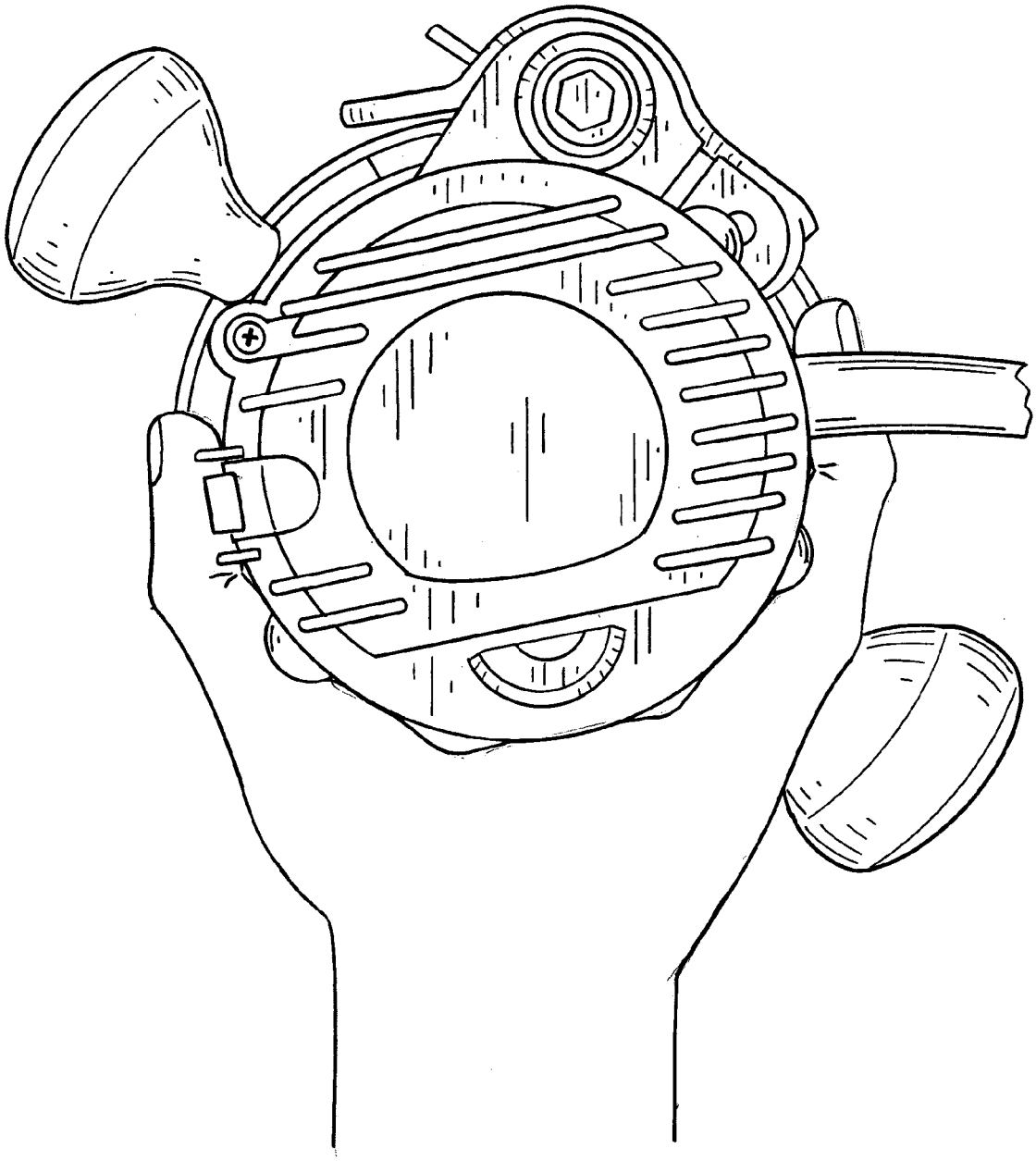
FIG. 3 is a top plan view illustration of right handed grasping of a router motor housing/base.

With particular reference to FIG. 2A, in the present embodiment, the electrical switch 220 is disposed substantially in a quadrant. A quadrant being defined by the first axis 218 and a second axis 222 which bisects the router/router motor and is normal to the first axis so as to divide the router into quarter sections or 90° (ninety degree) arcs for a cylindrical motor housing. For example, disposing the electrical switch in a front left quadrant 224 (as defined by the axis and electrical switch) allows a right-hand dominate user to manipulate the switch with the thumb of their right hand in a convenient manner while continuing to hold the handle or motor housing/base at least partially in their right hand. (As seen generally in FIG. 3) Disposing the electrical switch 220 a quadrant of the router assists in overcoming the manipulation difficulties experienced over a switch located on or nearly adjacent an axis (such as along a second axis 222).

Figure 2B:
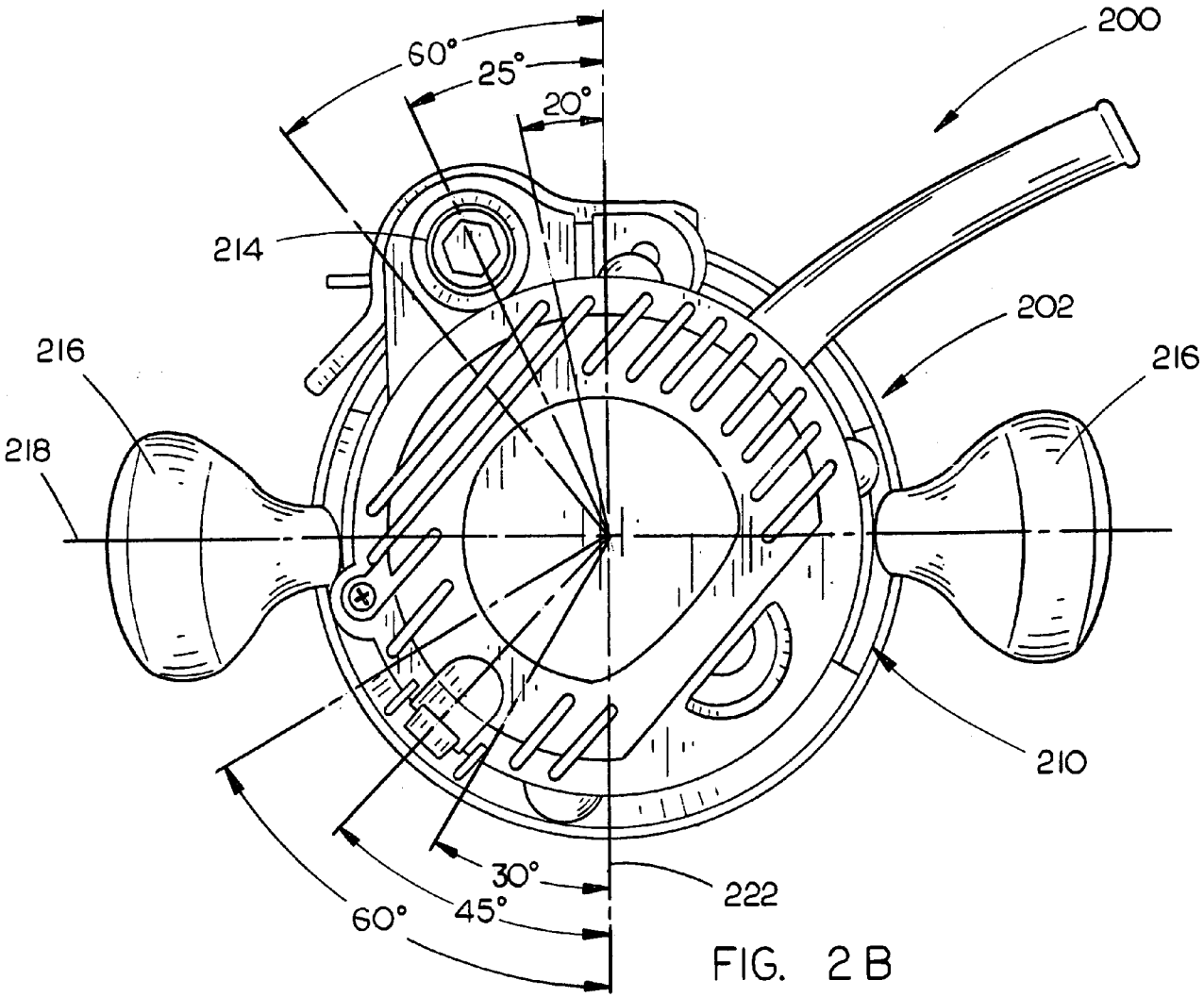
FIG. 2B is a top plan view of a router in accordance with an aspect of the present invention wherein a range of angular positions of a worm drive and electrical switch are indicated.

Referring to FIG. 2B, preferably, an electrical switch is disposed in the range of 30° (thirty degrees) to 60° (sixty degrees) from the second axis 222. This range allows a user to grasp the motor housing/base without interference for the typically expected range of users. For example, positioning an electrical switch in this range permits a user to grasp a side of the router (e.g. as defined by the second axis 222) without having to reach around the motor housing/base. In addition, the range allows for a convenient motion for turning the switch/actuator on or off. In a further exemplary embodiment, the switch is disposed at approximately 45° (forty-five degrees) from the second axis. This configuration promotes comfortable grasping and switch manipulation as well as minimizing potential inadvertent contact with the switch such as from a user's left hand when the switch is disposed in the left front quadrant. In the previous configuration, disposing the switch at approximately 45° (forty-five degrees) from a left side knob handle or first axis may allow for other router components to be disposed adjacent a knob handle such as support posts for a plunge base or the like.

Referring now to FIG. 1, in a further aspect of the invention a height adjustment device is included in a router 100. In a preferred embodiment, the height adjustment device is a worm drive 114 (the adjustment knob coupled to the worm drive is observed) mounted to a base for intermeshing with a rack included on a motor housing 102. The worm drive is pivotally mounted so as to cause the teeth forming the rack to move/vary position with respect to the base 110. In the foregoing manner the motor housing 102 and thus, a bit coupled to a drive shaft via a collet, or securing device, is raised/lowered with respect to the base. Alternatively, a threaded rod may be mounted to the motor housing for engaging a lug. Other suitable height adjustment devices include threaded rod systems, worm drive/engaging lug systems, step engagement systems, rack and pinion systems, and the like for varying the height of the motor housing while retaining a motor housing in a fixed orientation with respect to the base.

Referring to FIG. 2A, preferably, a height adjustment device maintains the motor housing in a fixed orientation with respect to the base such that a user may become familiar with the position of an electrical switch. In the present embodiment, the height adjustment device is mounted in a quadrant as defined by a first axis 218 and a second axis 222 as discussed previously. It is additionally preferable that the height adjustment device be disposed in a quadrant 126 directly adjoining or adjacent a quadrant containing an electrical switch. With regard to FIG. 2A, in the present embodiment the switch 220 is disposed in a left front quadrant 124 (as described previously) while a height adjustment device such as a worm drive 214 is disposed in a left rear quadrant 126. In this way, a right hand dominate user will not have to alter his/her grasp to avoid the worm drive when grasping the motor housing/base. (As generally observed in FIG. 3) Furthermore, the motor housing/base may be compact so as to minimize muscle strain in comparison to a device in which a user is forced to grasp, or at least partially grasp, the height adjustment device. In an alternate embodiment, an electrical switch is disposed in a right front quadrant while a height adjustment device is disposed in a right rear quadrant for accommodating a left hand dominate user.

Referring now to FIG. 2B, a router in accordance with a further embodiment includes a height adjustment device (e.g. a worm drive 214) which is disposed in the range of 30° (thirty degrees) to 60° (sixty degrees) from the second axis 222 and more preferably, disposed at approximately 25° (twenty-five degrees) from the second axis 222. The foregoing ranges are preferable for allowing ergonomic grasping of the motor housing 202, including convenient electrical switch operation. In addition, mounting the height adjustment device in this range prevents the apparatus from interfering with a user grasping a handle or extending the overall distance between handles. By disposing the height adjustment device in the range of range of 30° (thirty degrees) to 60° (sixty degrees) from the second axis 222 a user may cant his/her forearms inwardly and thereby be capable of positioning himself/herself in a comfortable position while operating the router 200.

It is believed that the apparatus of the present invention and many of its attendant advantages will be understood by the forgoing description. It is also believed that it will be apparent that various changes may be made in the form, construction and arrangement of the components thereof without departing from the scope and spirit of the invention or without sacrificing all of its material advantages. The form herein before described being merely an explanatory embodiment thereof. It is the intention of the following claims to encompass and include such changes.

What is claimed is:

1. A router, comprising:

a motor housing for at least partially enclosing a motor;

an electrical switch electrically coupled to the motor, the electrical switch being configured to control the flow of electricity to the motor; and a base constructed for at least partially supporting the router on a workpiece, said base including a sleeve for adjustably positioning the motor housing with respect to the base, while maintaining the motor housing in a fixed orientation, said base including first and second attachment points being additionally configured for securing a pair of generally opposing handles thereto, the first and second attachment points defining a first axis, wherein the electrical switch is disposed substantially in a quadrant of the motor housing defined by the first axis and a second axis which generally bisects the motor housing and is normal to the first axis, and further comprising a height adjustment device configured to adjust the position of the motor housing with respect to the base while maintaining the motor housing in a fixed orientation, the height adjustment device substantially completely disposed in a quadrant directly adjacent the quadrant including the electrical switch.

2. The router of claim 1, wherein the electrical switch is disposed at approximately 45° (forty-five degrees) from the second axis.

3. The router of claim 1, wherein the electrical switch is disposed in the range of 30° (thirty degrees) to 60° (sixty degrees) from the second axis.

4. The router of claim 1, wherein the height adjustment device is disposed in the range of 20° (twenty degrees) to 60° (sixty degrees) from the second axis.

5. The router of claim 4, wherein the height adjustment device is disposed at approximately 25° (twenty-five degrees) from the second axis.

6. The router of claim 1, wherein the electrical switch is disposed in a left front quadrant defined by the first axis and the second axis.

7. The router of claim 6, wherein the height adjustment device is disposed in a left rear quadrant defined by the first axis and the second axis.

8. A router, comprising:

a motor housing for at least partially enclosing a motor;

an electrical switch electrically coupled to the motor, the electrical switch being configured to control the flow of electricity to the motor;

a base constructed for at least partially supporting the router on a workpiece, said base including a sleeve for adjustably receiving the motor housing therein with respect to the base, while maintaining the motor housing in a fixed orientation; and a handle mounted to the base for manipulating the router, said handle defining a first axis;

a second axis which generally bisects the motor housing and is normal to the first axis; and a height adjustment device configured to adjust the position of the motor housing with respect to the base while maintaining the motor housing in a fixed orientation, wherein the electrical switch is disposed substantially in a first quadrant defined by the first axis and the second axis, and the height adjustment device is disposed substantially completely in a second quadrant defined the first axis and the second axis, the second quadrant being directly adjacent to the first quadrant.

9. The router of claim 8, wherein the electrical switch is disposed at approximately 45° (forty-five degrees) from the second axis.

10. The router of claim 8, wherein the height adjustment device is disposed in the range of 20° (twenty degrees) to 60° (sixty degrees) from the second axis.

11. The router of claim 10, wherein the height adjustment device is disposed at approximately 25° (twenty-five degrees) from the second axis.

12. The router of claim 8, wherein the electrical switch is disposed in a left front quadrant defined by the first axis and the second axis.

13. The router of claim 12, wherein the height adjustment device is disposed in a left rear quadrant.

14. The router of claim 8, wherein the electrical switch is disposed in the first quadrant in the range of 30° (thirty degrees) to 60° (sixty degrees) from the second axis.

15. A router, comprising:

a generally cylindrical motor housing for at least partially enclosing a motor;

an electrical switch electrically coupled to the motor, the electrical switch being configured to control the flow of electricity to the motor;

a base constructed for at least partially supporting the router on a workpiece, said base including a sleeve for adjustably receiving the motor housing therein with respect to the base, while maintaining the motor housing in a fixed orientation, said base including first and second attachment points being additionally configured for securing a pair of generally opposing handles thereto, first and second attachment points defining a first axis; and a height adjustment device configured to adjust the position of the motor housing with respect to the base while maintaining the motor housing in a fixed orientation, wherein the electrical switch is disposed substantially in a left front quadrant, defined by the first axis and a second axis which generally bisects the motor housing and is normal to the first axis, at approximately 45° (forty-five degrees) from a second axis and the height adjustment device is disposed substantially completely in a left rear quadrant.

* * * * *